US006209247B1

(12) United States Patent
Boccanfuso

(10) Patent No.: US 6,209,247 B1
(45) Date of Patent: Apr. 3, 2001

(54) ORNAMENT WITH PIVOTABLE DISPLAY ASSEMBLY

(75) Inventor: Ronald J. Boccanfuso, West Warwick, RI (US)

(73) Assignee: Precision Etchings & Findings. Inc., Warwick, RI (US)

( * ) Notice: Subject to any disclaimer, the term of this patent is extended or adjusted under 35 U.S.C. 154(b) by 0 days.

(21) Appl. No.: 09/500,286

(22) Filed: Feb. 8, 2000

(51) Int. Cl.[7] ..... A47G 1/16
(52) U.S. Cl. ..... 40/747; 40/734
(58) Field of Search ..... 40/747, 734, 610, 40/503, 506; 428/7

(56) References Cited

U.S. PATENT DOCUMENTS

| | | | | |
|---|---|---|---|---|
| D. 176,525 | | 1/1956 | Katz . | |
| D. 328,572 | | 8/1992 | Dudley . | |
| 1,329,615 | | 2/1920 | Langfelder . | |
| 1,448,664 | | 3/1923 | Hull . | |
| 1,553,198 | | 9/1925 | Stern . | |
| 2,515,053 | * | 7/1950 | Nesel | 40/747 |
| 2,585,183 | | 2/1952 | Stern . | |
| 2,616,199 | | 11/1952 | Robins . | |
| 2,890,536 | | 6/1959 | Sly . | |
| 3,164,923 | | 1/1965 | Knott . | |
| 3,596,380 | | 8/1971 | Williams . | |
| 4,215,194 | | 7/1980 | Shepherd . | |
| 4,970,878 | | 11/1990 | Lee . | |
| 6,112,445 | * | 9/2000 | Feeney | 40/747 |

* cited by examiner

*Primary Examiner*—Joanne Silbermann
(74) *Attorney, Agent, or Firm*—Salter & Michaelson

(57) ABSTRACT

An ornament with a pivoting display assembly is provided. The ornament includes a flexible frame assembly that allows insertion of the display assembly into the frame assembly, within which the display assembly is pivotable.

9 Claims, 13 Drawing Sheets

ORNAMENT WITH PIVOTABLE DISPLAY ASSEMBLY

BACKGROUND

1. Field of the Invention

The present invention is directed to an ornament and, in particular, to an ornament that includes a pivotable display assembly.

2. Related Art

U.S. Pat. No. 4,970,878 discloses a jewelry mounting apparatus that includes a planar mounted frame adapted to rotate about an axis for the purpose of displaying opposing surfaces of coins, gems, ornamental objects, and the mounting components.

U.S. Pat. No. 1,329,615 discloses a Christmas ornament having a semi-rigid frame formed from several pieces of a tubular member interconnected by a wire threaded therethrough.

SUMMARY

The present invention is directed to an ornament that includes a frame assembly, a display assembly disposed within the frame assembly, and two opposing pivot members disposed between the frame assembly and the display assembly.

In another embodiment, the ornament includes a frame assembly, a display assembly disposed within the frame assembly, and two opposing engaging members disposed between the frame assembly and the display assembly. The display assembly includes two opposed pivot members adapted to be slidably received in the engaging member. The frame assembly includes two opposed sets of grooves adapted to slidably receive the engaging member. The display assembly is adapted to pivot within the frame assembly.

The invention is also directed to a method of assembling an ornament including providing a frame assembly that is flexible between a first position and a second position, providing a display assembly, inserting the display assembly into the frame assembly when the frame assembly is in the first position, flexing the frame assembly into the second position, inserting the display assembly into the frame assembly when the frame assembly is in the second position, and allowing the frame assembly to return to the first position.

Other objects, features and advantages of the invention shall become apparent as the description thereof proceeds when considered in connection with the accompanying illustrative drawings.

DETAILED DESCRIPTION

The present invention is directed to an ornament that includes an outer frame assembly and an inner display assembly that is pivotally connected to the outer frame assembly. The outer frame assembly is flexible between a first position and a second position. The inner display assembly may be pivotally mounted within the outer frame assembly by flexing the outer frame assembly between the first and second positions.

Figure 1:
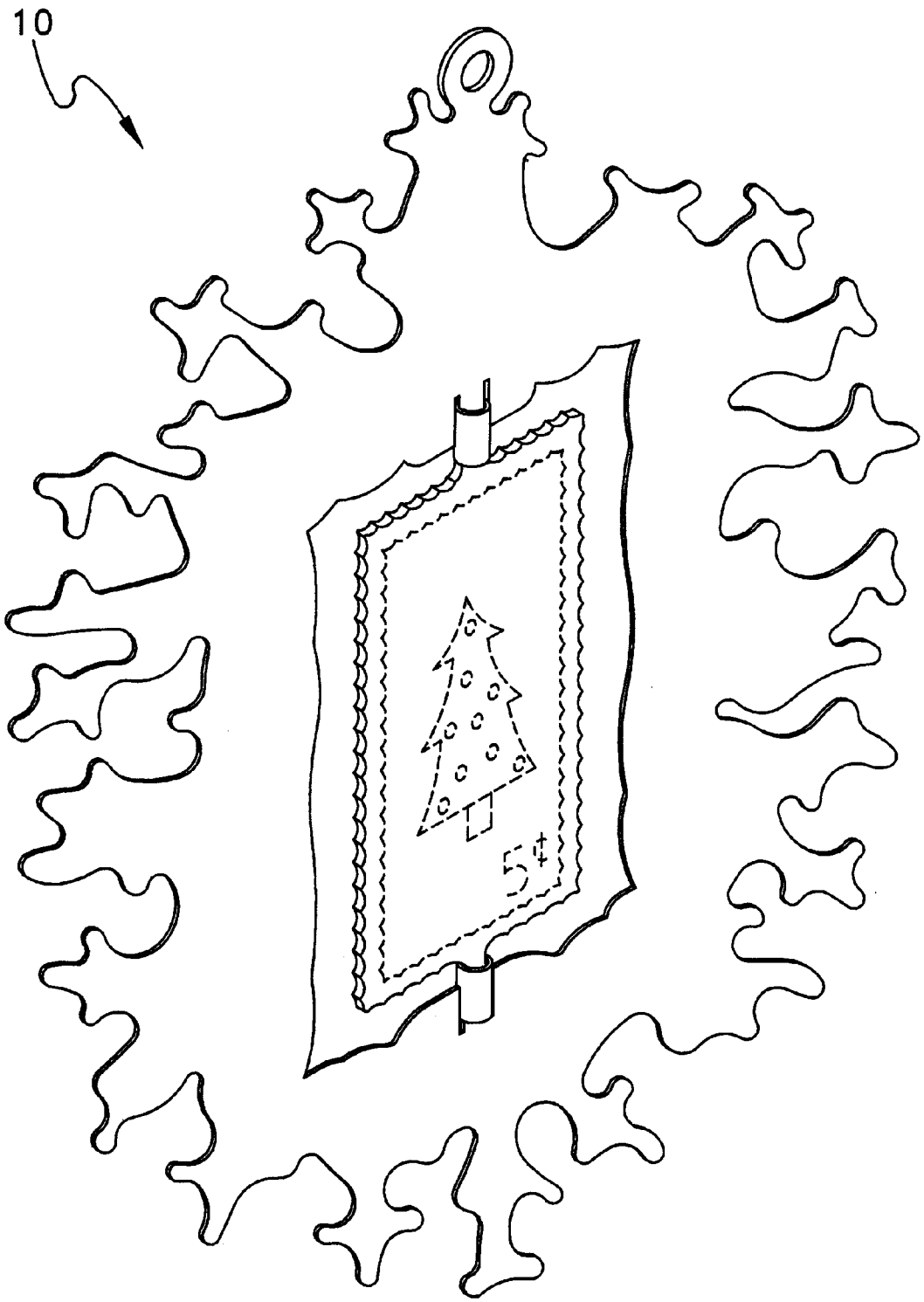
FIG. 1 is a perspective schematic illustration of an ornament according to one embodiment of the present invention.
Figure 2:
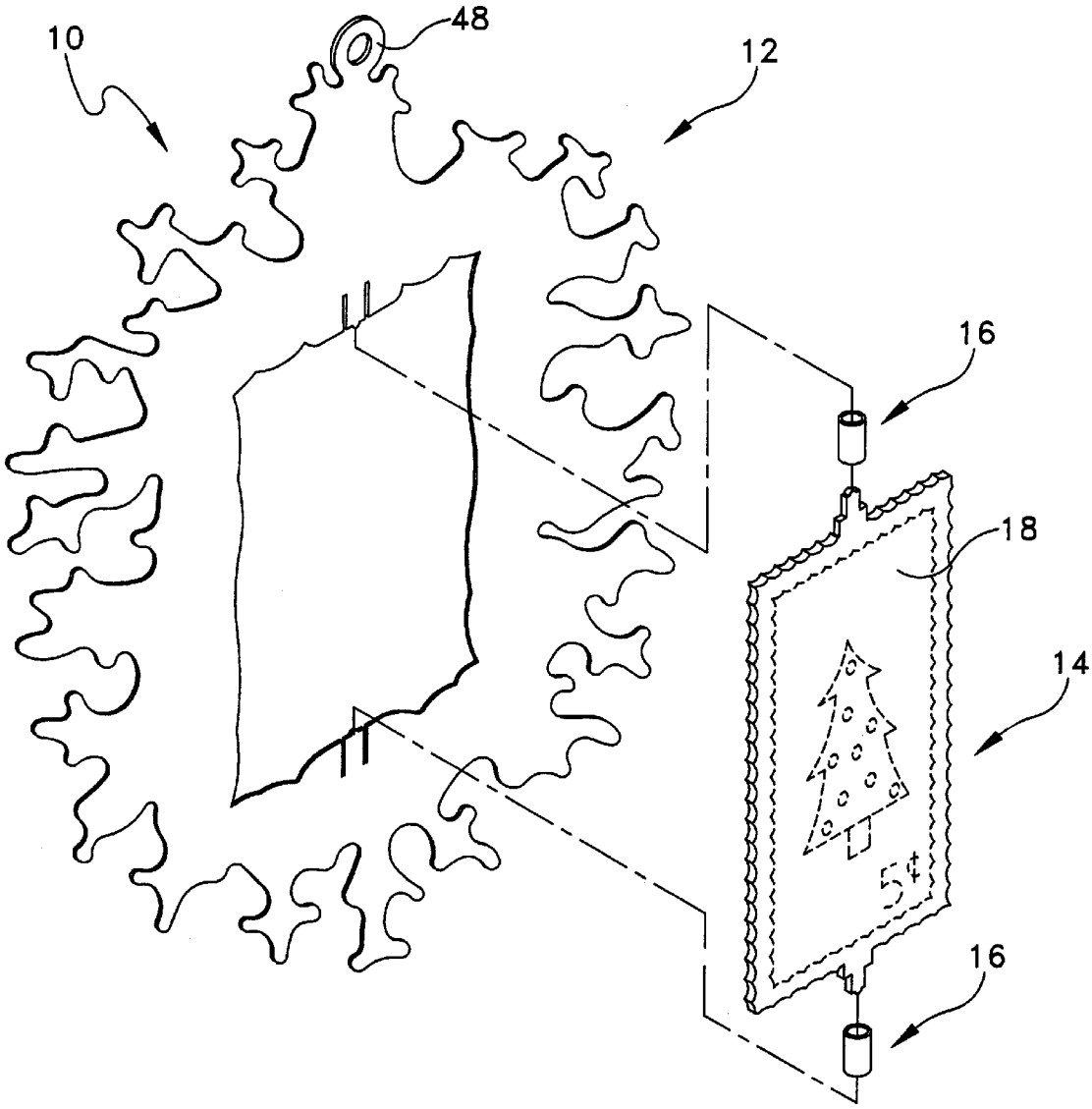
FIG. 2 is an expanded illustration of the ornament shown in FIG. 1.

FIG. 1 is a perspective view of one embodiment of an ornament 10 according to the present invention. FIG. 2 shows ornament 10 in an exploded view. Ornament 10 includes an outer frame assembly 12, a display assembly 14, and two engaging or pivot members 16 for cooperatively engaging outer frame assembly 12 and display assembly 14. Although illustrated herein as substantially planar, outer frame assembly 12 may have a non-planar geometry as well. "Engaging member," as used herein, is meant to define any member adapted to receive a boss member, which is described in greater detail below. In preferred embodiments, engaging members 16 may be tubes or tube-like members, for ease of manufacturing and assembly. However, the engaging member is not restricted to tubes or hollow members and may be any member adapted to the function of receiving the boss member. In some embodiments, ornament 10 may also include an article for display 18. In some embodiments, ornament 10 may also include an eye 48 that may be integrally formed with the outer frame assembly, or attached thereto, to allow hanging of the ornament.

Figure 3:
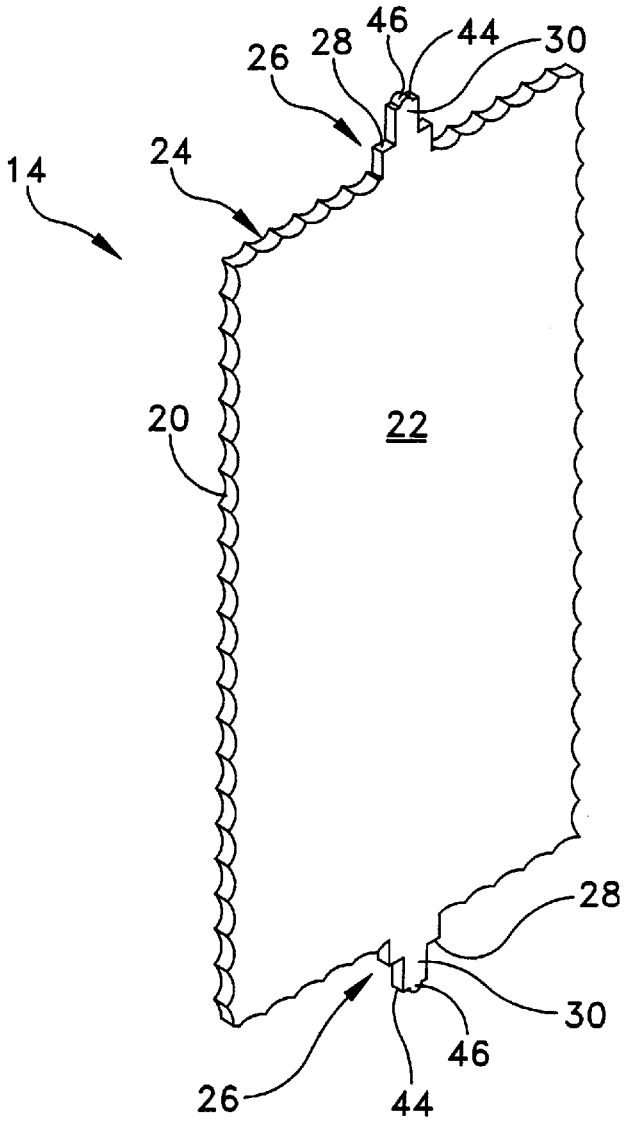
FIG. 3 is an enlarged schematic illustration of the display assembly portion of the ornament shown in FIG. 1.

FIG. 3 illustrates an expanded view of display assembly 14, which is illustrated herein as substantially planar, but which those of skill in the art will recognize may have any geometric shape. Display assembly 14 includes an outer edge 20, opposing surfaces 22, 24, and two opposing boss members 26 extending from the outer edge 20. Each boss member 26 includes at least one shoulder 28 which defines a pivot member or lug 30. "Pivot member," as used herein, means a member on which something turns, such as, but not limited to a shaft, pin, peg, plug or the like. Each pivot member 30 has a width that is smaller than the width of boss member 26. Each pivot member 26 includes an outer edge 44 that may include a protrusion 46, as illustrated. Alternatively, edge 44 may have a substantially flat edge. Protrusions 46 are preferably arcuate and are designed to provide an area about which the ornament may pivot. Those of skill in the art will recognize that the protrusions are not necessary to the invention and are included to reduce wear due to friction.

An article 18 for display may be attached to or formed in or on one or both of opposing surfaces 22, 24. For example, articles 18 having a pre-pasted backing, such as stamps, may be attached to either or both of surfaces 22, 24. Alternatively, an article 18 may be fixedly attached by glue, tape, or any other method known to those of skill in the art. Alternatively still, a display may be formed in one or both surfaces 22, 24 by etching, and the like.

Figure 4:
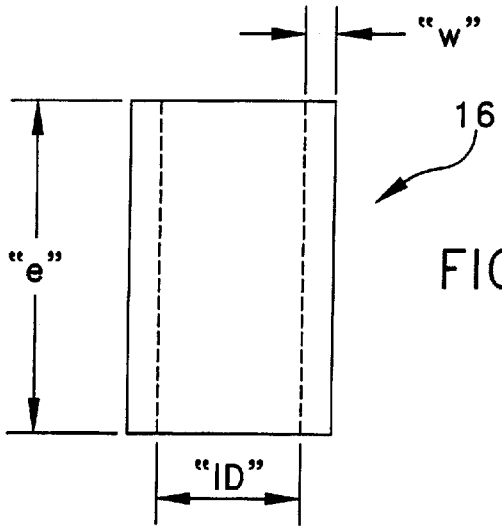
FIG. 4 is an enlarged schematic illustration of a portion of the outer frame assembly of the ornament shown in FIG. 1.

FIG. 4 illustrates schematically engaging member 16 having a length "1" that is preferably sufficient to accommodate at least a portion of one display assembly pivot member 30 and one outer frame assembly tab member 42, which is described in greater detail below. Preferably, each engaging member 16 has a length sufficient to accommodate receiving the entire length of one pivot member 30 and one tab member 42. Engaging member 16 preferably has a wall thickness "w" and an inner diameter "ID."

Figure 5:
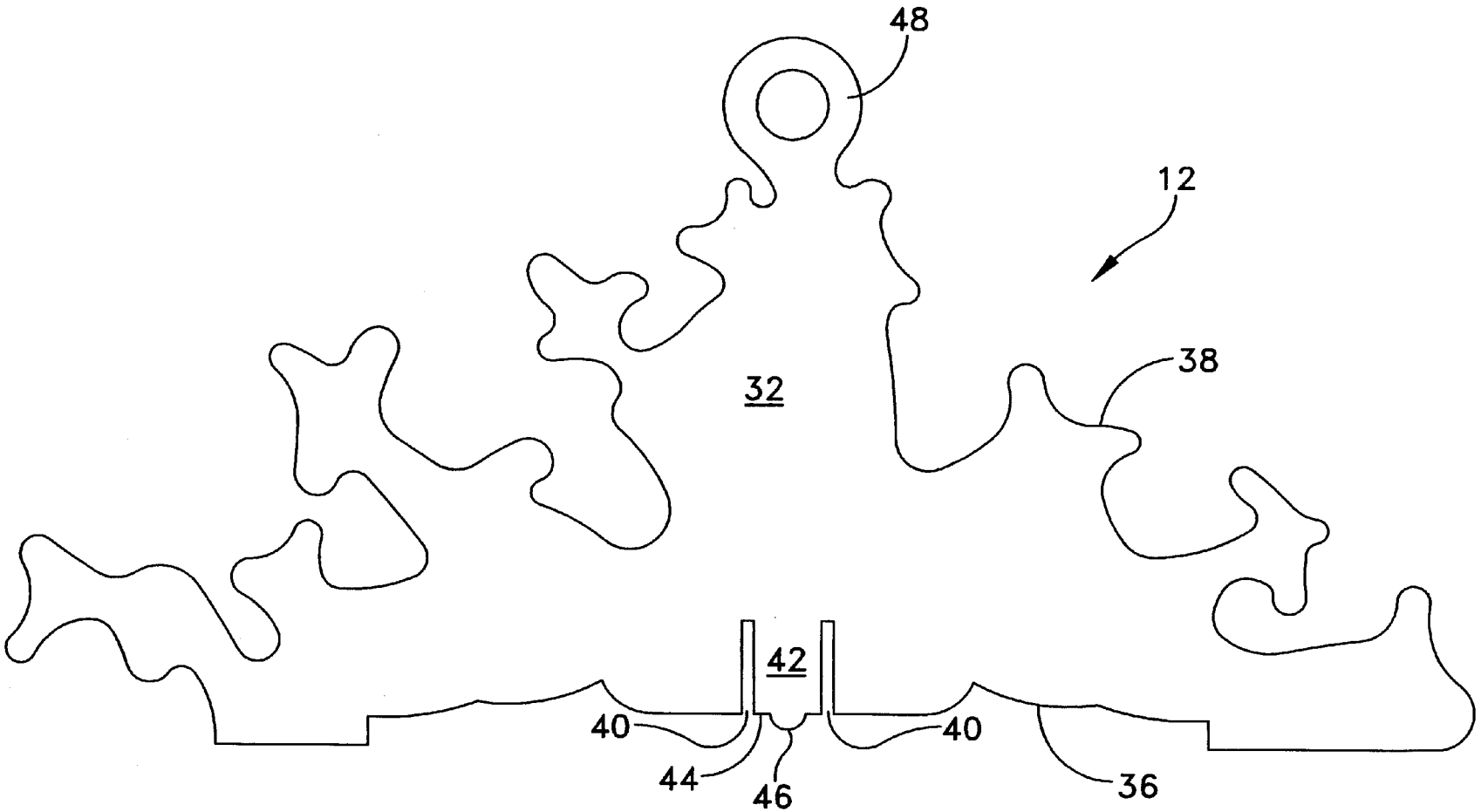
FIG. 5 is an enlarged schematic illustration of the engaging member of the ornament shown in FIG. 1.

FIG. 5 illustrates an expanded partial view of outer frame assembly 12 according to the present embodiment. Outer frame assembly 12 must be sufficiently flexible to accommodate insertion of the display assembly 14, as described in greater detail below. Suitable materials for the outer frame assembly 12 include, but are not limited to, metal, plastic, cardboard, and the like. Outer frame assembly 12 includes opposing surfaces 32, 34 (see FIG. 12) and inner and outer edges 36, 38. Opposing surfaces 32,34 may include decorative or ornamental details, and may be substantially similar or different. Two sets of parallel grooves 40 extend completely through the outer frame assembly 12 from surface 32 to surface 34 to define tab members 42. Each parallel groove 40 has a width slightly greater than "w," the width of the engaging member 16." Each tab member 42 has a width that is preferably slightly less than the inner diameter "ID" of the engaging member 16. Each tab member 42 preferably has an edge 44 that includes a protrusion 46 that is preferably arcuate. Those of skill in the art will recognize that the protrusions are not necessary to the invention and are included to reduce wear due to friction.

Figure 6:
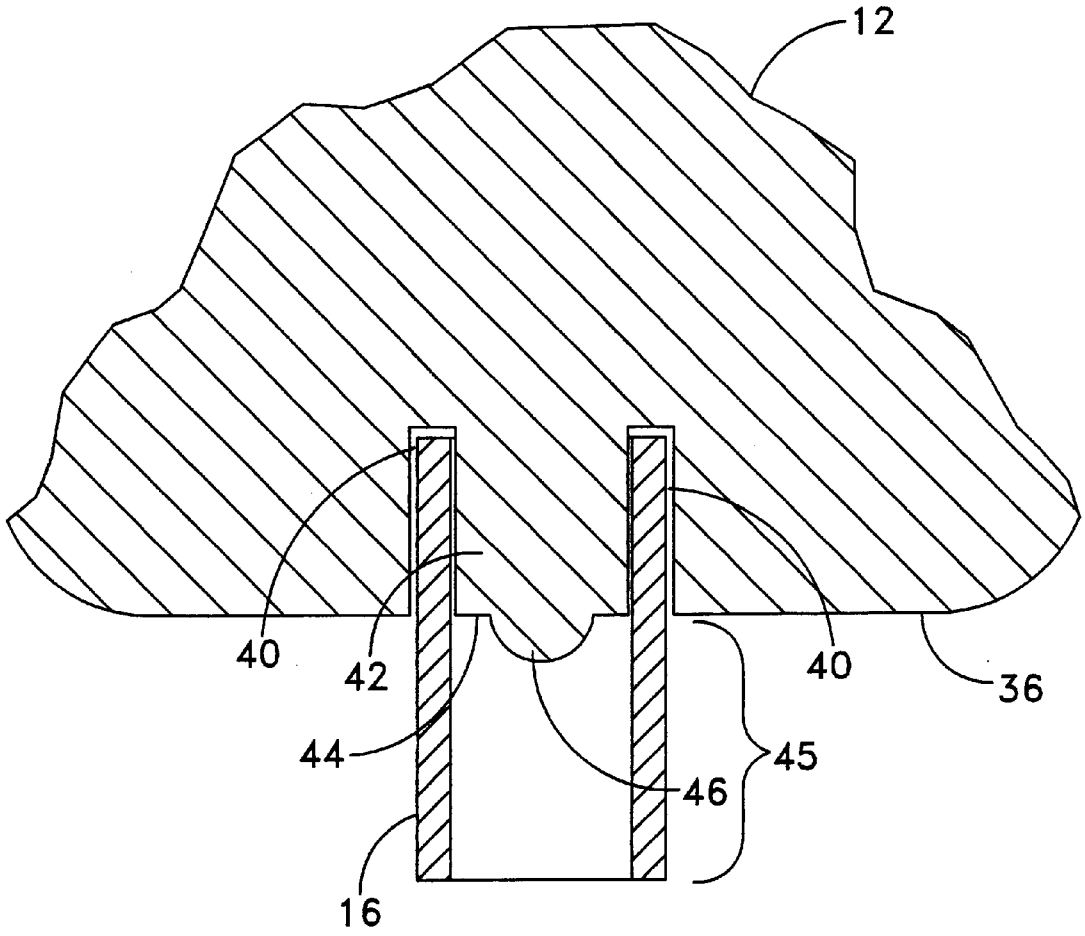
FIG. 6 is an enlarged schematic illustration showing the engaging member in an assembled configuration with the outer frame assembly of the ornament shown in FIG. 1.

FIG. 6 illustrates schematically engaging member 16 positioned in one set of parallel grooves 40. Engaging member 16 is adapted to be slidably received in parallel grooves 40 such that a remaining portion 45 of engaging member 16 extends from inner edge 36 of outer frame assembly 12. The remaining portion 45 of engaging member 16 that extends from outer frame assembly 12 is adapted to receive display assembly pivot members 30.

Figure 7:
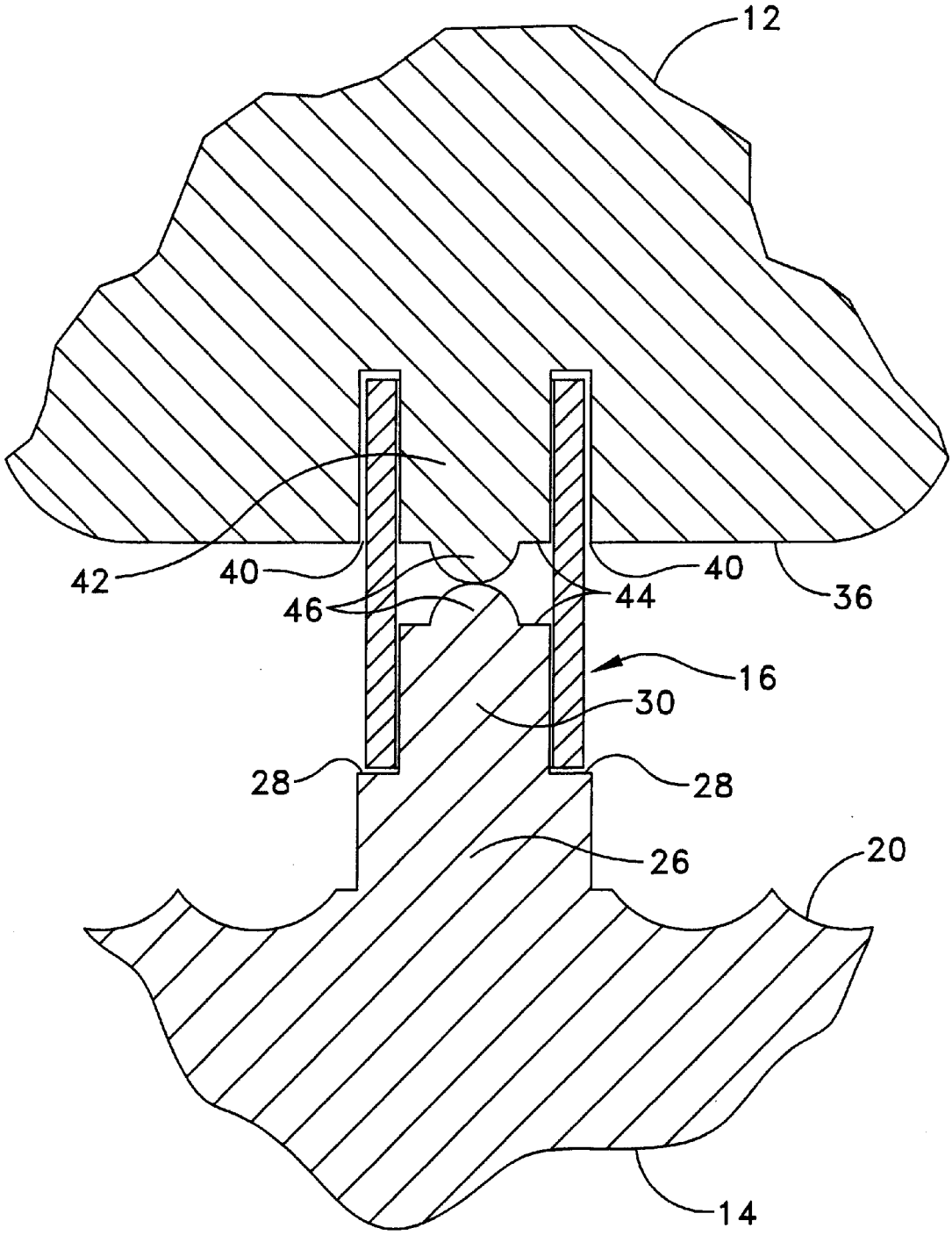
FIG. 7 is an enlarged schematic illustration showing the engaging member in an assembled configuration with the outer frame assembly and the display assembly of the ornament shown in FIG. 1.

FIG. 7 is a schematic illustration of engaging member 16 in an assembled configuration with outer frame assembly 12 and display assembly 14. As shown, engaging member 16 is slidably engageable on pivot members 30 of display assembly 14 and in parallel grooves 40 of outer frame assembly 12. In some embodiments, engaging members 16 may be fixedly attached to the display assembly 14 and the outer frame assembly 12 by applying a fixative, such as glue, before slidably inserting them into the parallel grooves 40 or onto pivot members 30.

Those of skill in the art will recognize that the invention includes structures in which the grooves are disposed on the display assembly and the boss members are disposed on the outer frame assembly. In addition, although illustrated herein as a hanging ornament, those of skill in the art will recognize the that ornament may be supported on a stand, which is not illustrated herein, but is known in the art. Finally, those of skill in the art will recognize that the pivot axis may be in any orientation.

Figure 8:
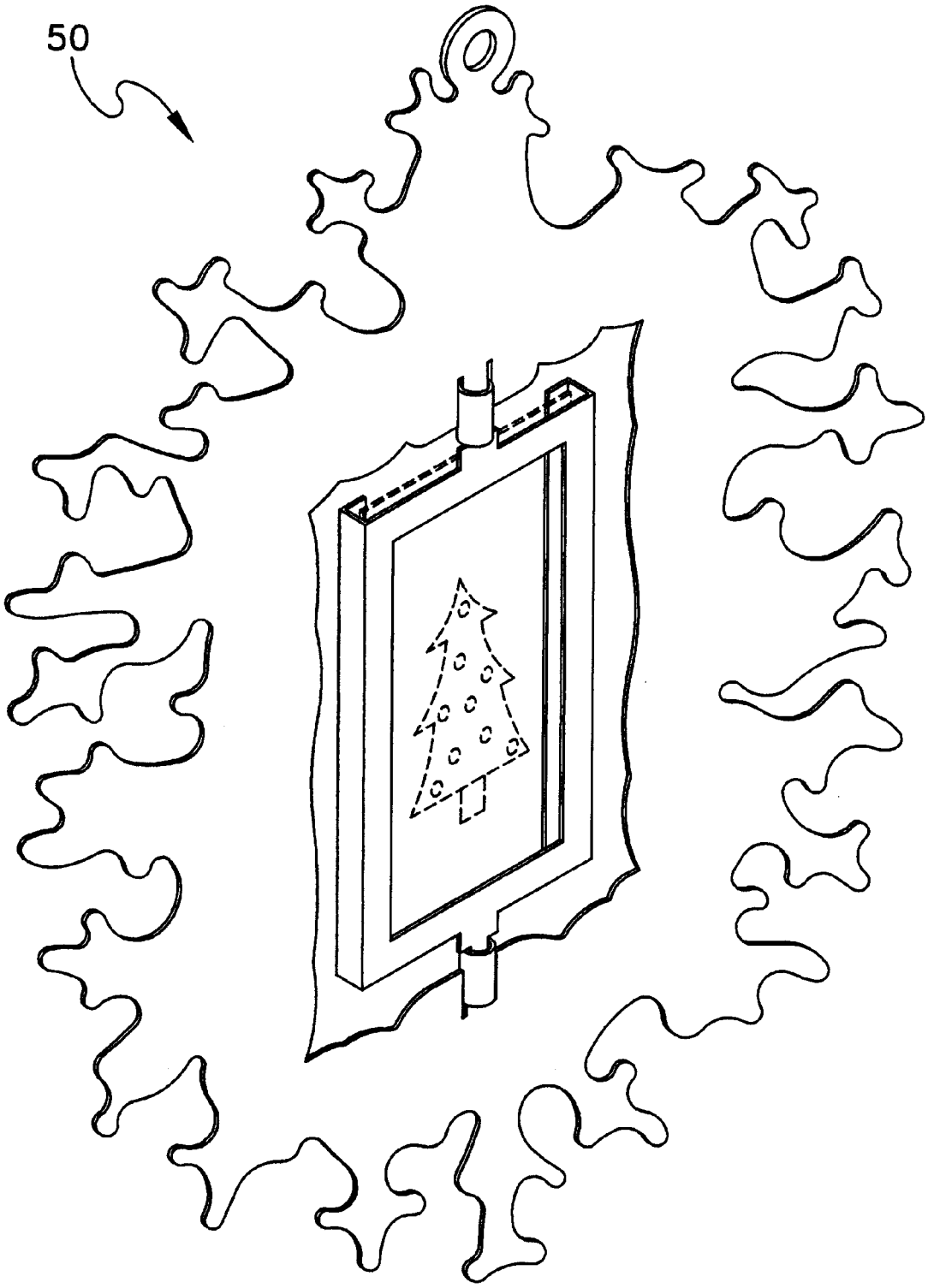
FIG. 8 is a perspective schematic illustration of an ornament according to another embodiment of the present invention.
Figure 9:
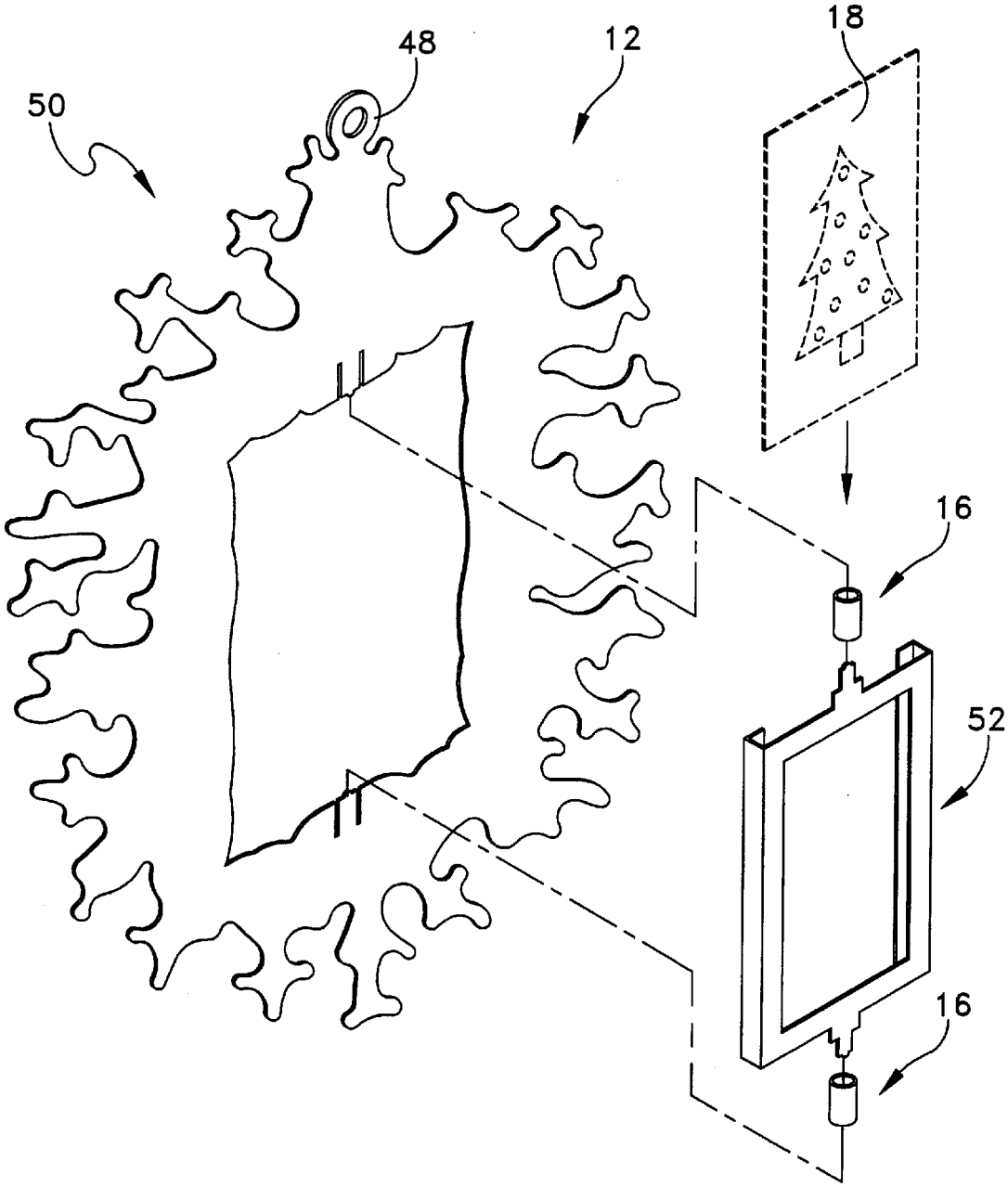
FIG. 9 is an exploded illustration of the ornament shown in FIG. 8.

FIG. 8 is a perspective illustration of another embodiment of an ornament 50 according to the present invention, wherein like numbers represent like elements. Ornament 50 is shown in exploded view in FIG. 9, and includes a display assembly 52, engaging members 16, and an article for display 18.

Figure 10:
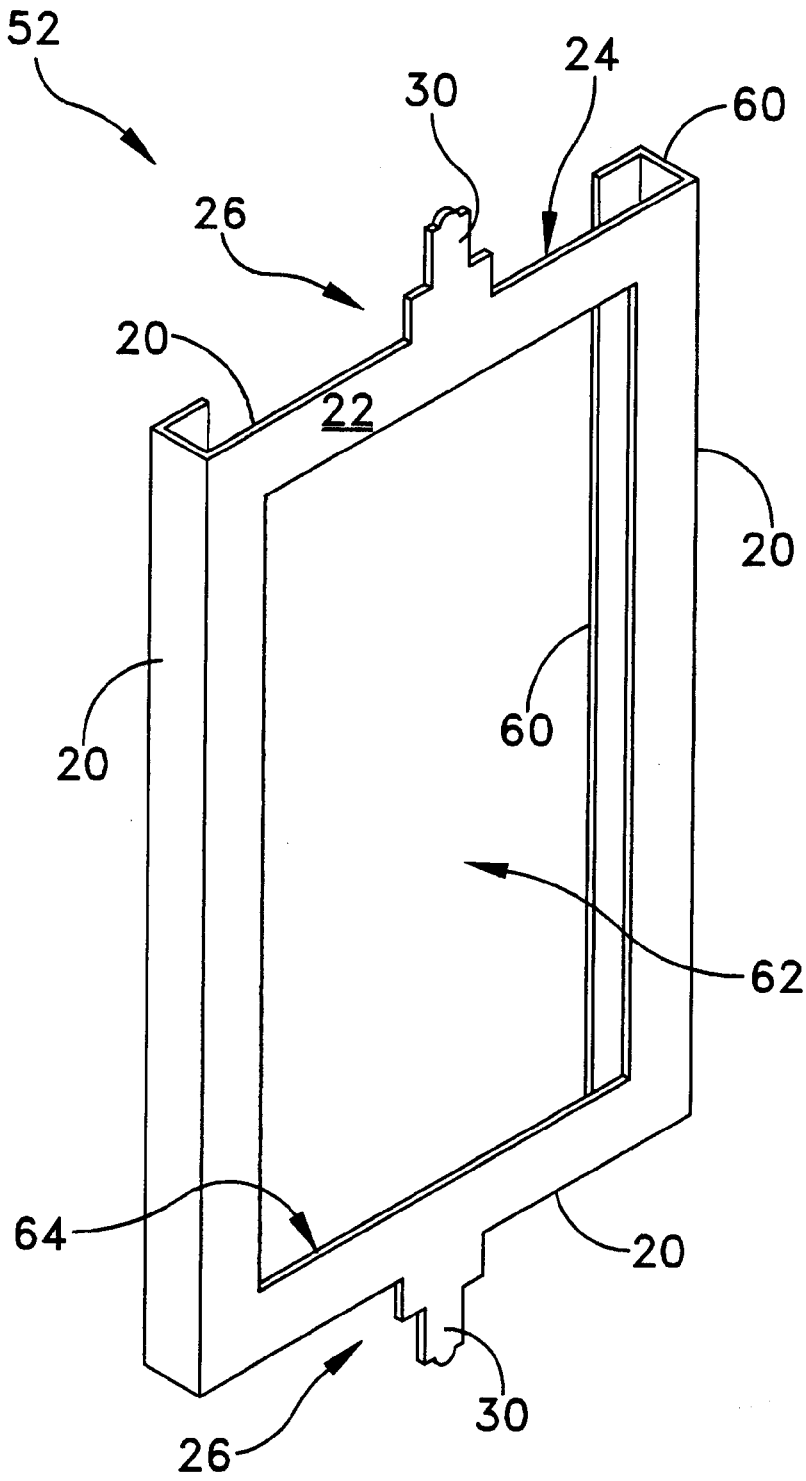
FIG. 10 is an enlarged schematic illustration of the display assembly portion of the ornament shown in FIG. 8.

Display assembly 52 is shown in expanded perspective view in FIG. 10. Display assembly 52 includes outer edge 20 and opposing surfaces 22, 24. A flange 60 is disposed around at least a portion of outer edge 20. Flange 60 is adapted to frame and receive an article 18 for display for viewing on one side of display assembly 54. In the present embodiment, display assembly 52 also includes an aperture 62 extending from surface 22 to surface 24 and defined by an inner edge 64. Thus, inner edge 64 provides a frame for article 18 for display, which may be viewed through aperture 62 from either surface 22, 24 of display assembly 52. As in the previous embodiment, display assembly 52 is illustrated herein as substantially planar or rectangular, but those of skill in the art will recognize that it may have any geometric shape on which display items may be fixedly attached, or in which permanent displays may be formed. Display articles 18 may be attached to surfaces 22, 24 by glue, tape, or any other method known to those of skill in the art. For example, display articles 18 may be items having a pre-pasted backing, such as stamps, that are attached to either of the surfaces 22, 24. Alternatively still, a display may be formed on one or both surfaces 22, 24 by etching, and the like.

Figure 11:
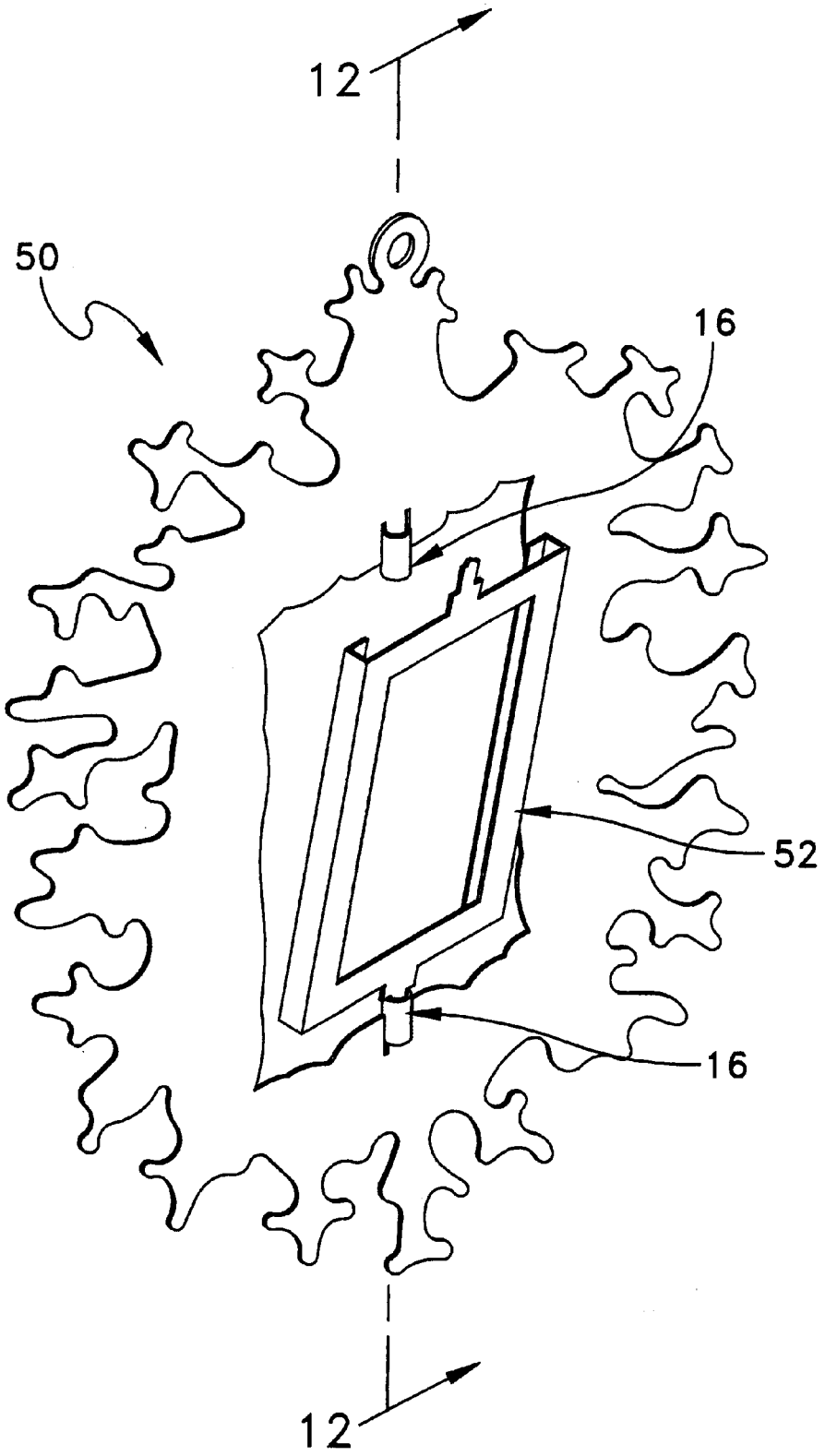
FIGS. 11–13 are schematic illustrations of a method of assembling the ornament shown in FIGS. 1 and 8.
Figure 12:
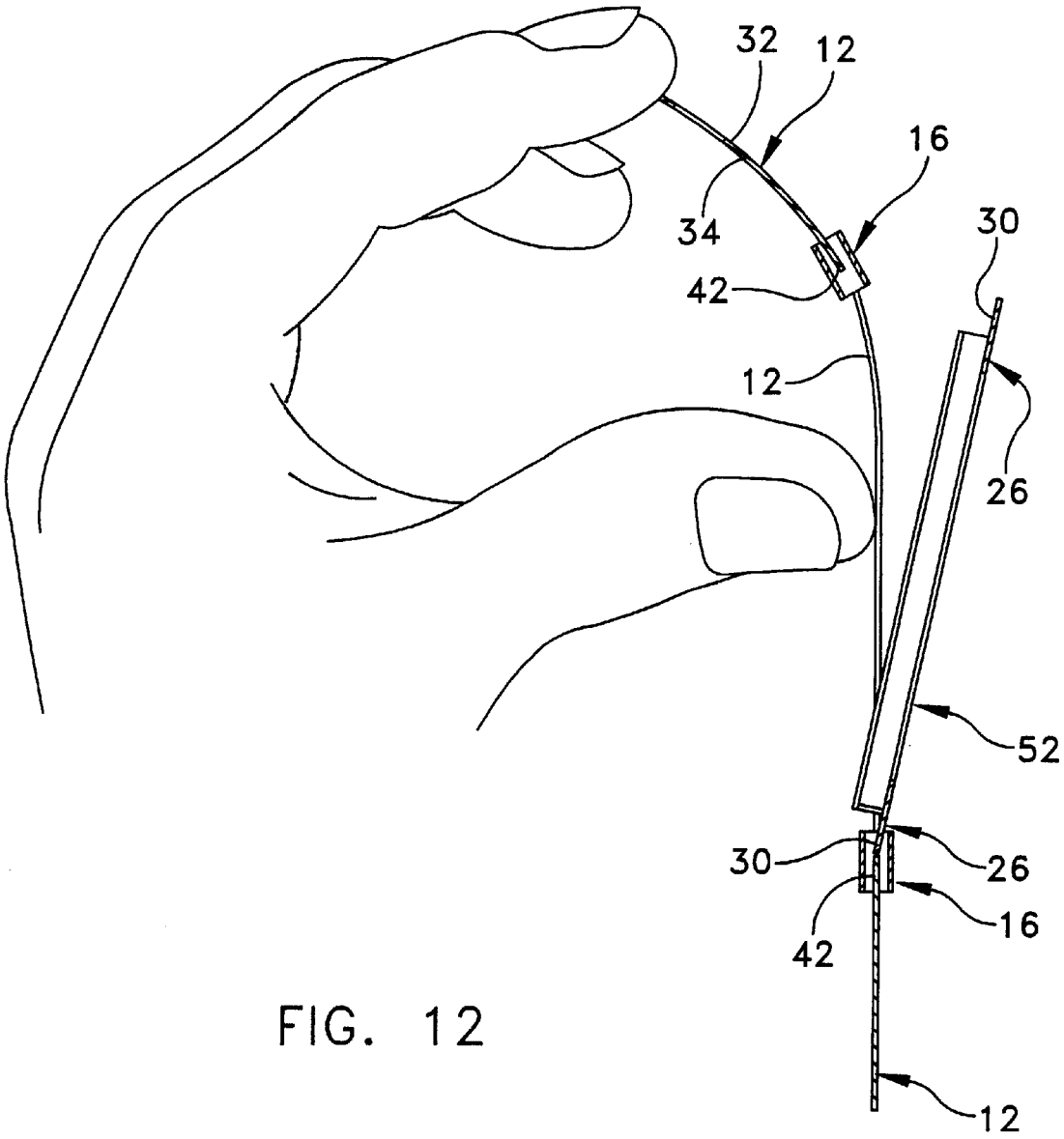
Figure 13:
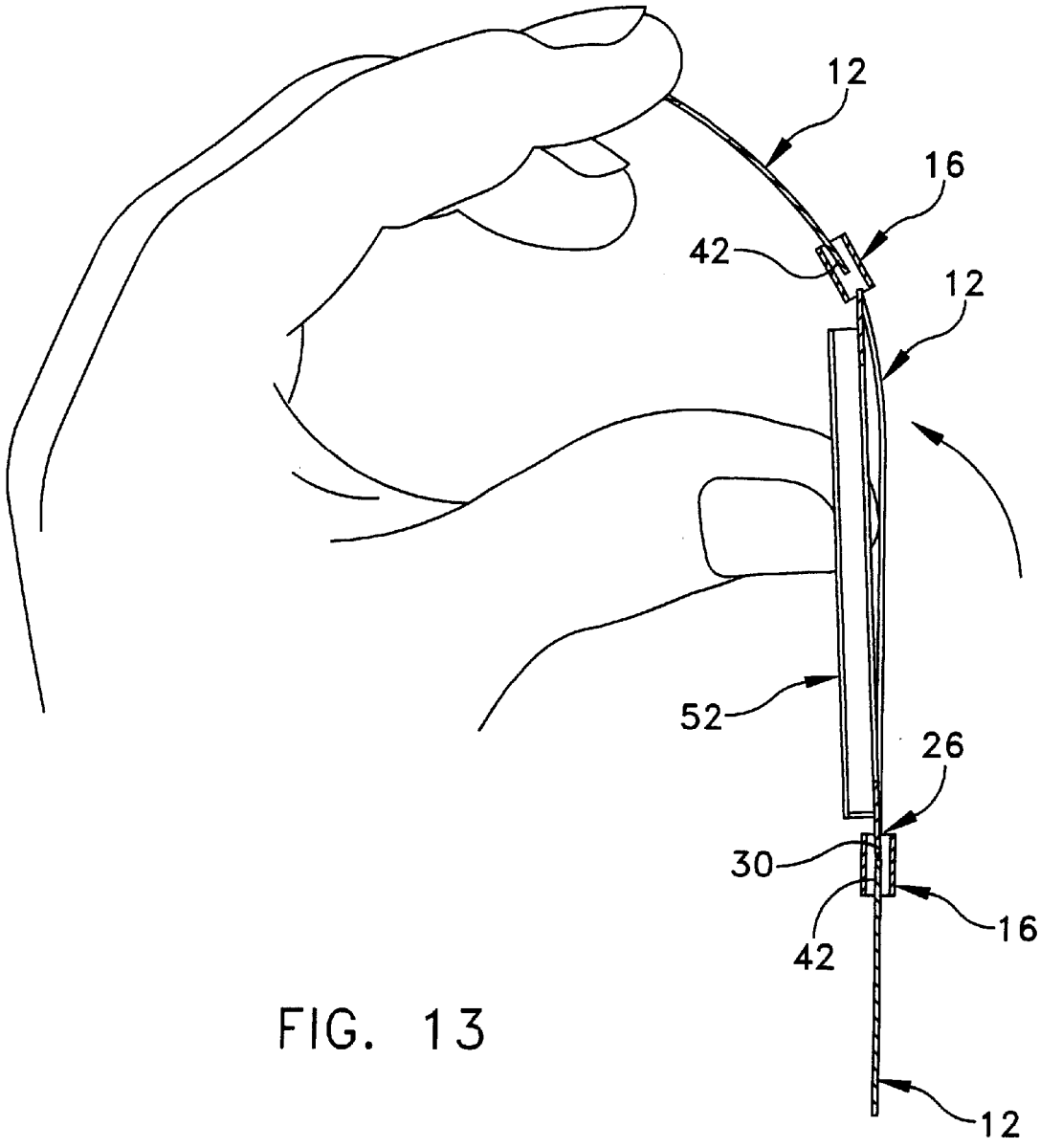

A method of assembling the ornaments according to any embodiment of the present invention will now be illustrated with references to FIGS. 11 through 15. As shown in FIG. 11, one engaging member 16 is slidably inserted into each set of parallel grooves 40 on outer frame assembly 12. One display assembly pivot member 30 is inserted into an engaging member 16, preferably the lower engaging member, as shown in FIG. 11. The outer frame assembly 12 is then flexed to a first position, as shown in FIG. 12. The display assembly 52 is then moved toward the upper engaging member, as shown in FIG. 13, and the second display assembly pivot member 30 is positioned in the second engaging member 16. After both display assembly pivot members 30 have been inserted into each of the engaging members, outer frame assembly 12 is allowed to return to its original position.

Figure 14:
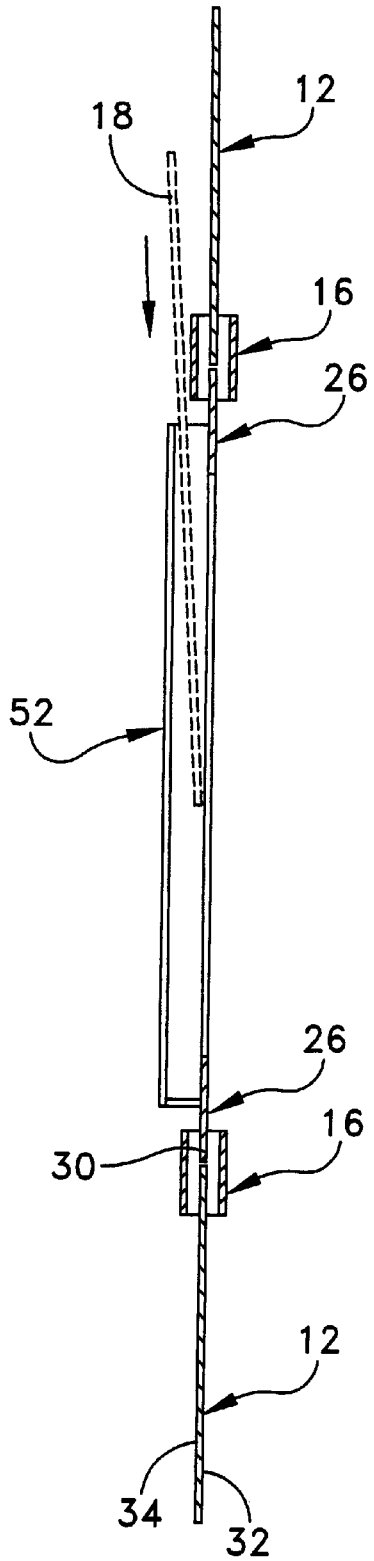
FIGS. 14–15 are schematic illustrations of a method of displaying an article in the ornament shown in FIG. 8.
Figure 15:
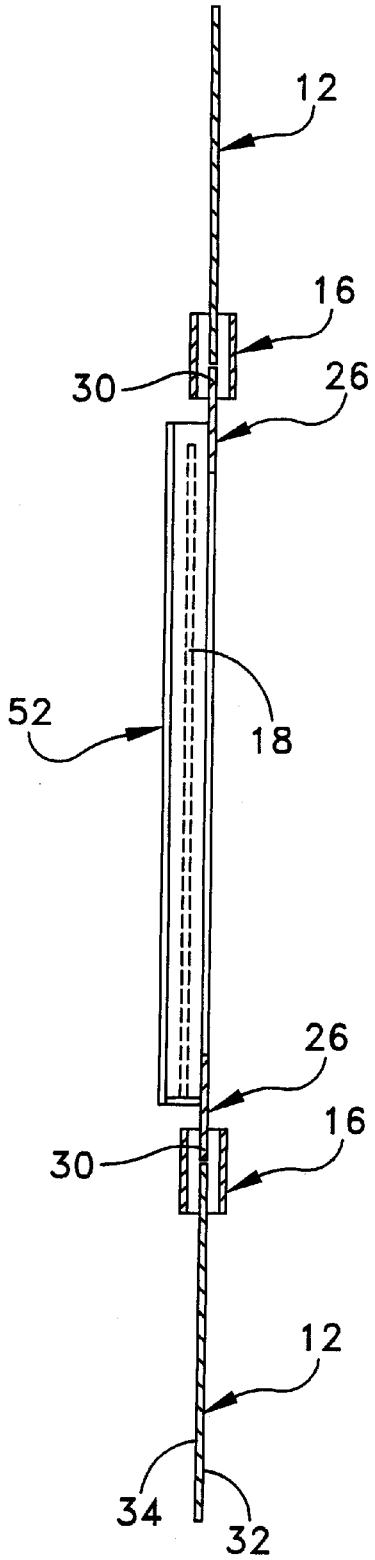

A method of assembly with respect to an article 18 will now be illustrated with respect to FIGS. 14 and 15. As shown in FIG. 14, an article 18 may be slidably inserted into flange 60 of display assembly 52. FIG. 14 schematically illustrates in side view the fully assembled ornament 50 including an article 18.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An ornament, comprising:

a frame assembly;

a display assembly disposed within the frame assembly;

two opposing engaging members disposed between the frame assembly and the display assembly;

the display assembly including two opposed pivot members adapted to be slidably received in the engaging members;

the frame assembly including two opposed sets of grooves, each said set being adapted to slidably receive one of the engaging members;

wherein the display assembly is adapted to pivot within the frame assembly.

2. The ornament of claim 1, wherein the display assembly includes at least one display surface.

3. The ornament of claim 1, wherein the display assembly includes an outer edge, and a flange extending around at least a portion of the outer edge, such that the flange is adapted to slidably receive an article.

4. The ornament of claim 1, wherein the display surface includes an aperture, such that the aperture defines a frame for displaying an article.

5. The ornament of claim 1, wherein the display assembly includes at least one display surface, and the display surface includes an aperture that defines a frame for displaying an article.

6. An ornament comprising:

a flexible frame;

a display assembly positioned within said frame;

a pair of pivot members assembled to said frame in oppositely disposed relation, said pivot members each having a bore facing toward the interior of said frame;

said display assembly having oppositely disposed pivot lugs interengaged within said bores so as to pivotally mount said display assembly within said frame;

wherein the flexibility of said frame enables the frame to be manipulated to permit entry of said lugs into said bores.

7. The ornament of claim 6 further characterized in that said pivot members are slidably and frictionally assembled to said frame.

8. The ornament of claim 6 further characterized in that said pivot lugs extend integrally from said display assembly.

9. The ornament of claim 6 further characterized in that said frame is substantially flat and is ornamentally configured.

* * * * *

Disclaimer 6,209,247 — Ronald J. Boccanfuso, West Warwick, RI. ORNAMENT WITH PIVOTABLE DISPLAY ASSEMBLY. Patent dated April 3, 2001. Disclaimer filed August 30, 2001, by the assignee, Precision Etchings & Findings, Inc.

Hereby enters this disclaimer to claims 6, 7, 8, and 9.

(*Official Gazette, May 14, 2002*)